United States Patent [19]

Dominguez

[11] Patent Number: 4,711,068

[45] Date of Patent: Dec. 8, 1987

[54] PACKAGING MACHINES AND WEAR STRIPS THEREFOR

[75] Inventor: Ben Dominguez, Pasadena, Tex.

[73] Assignee: Formers of Houston, Inc., Pasadena, Tex.

[21] Appl. No.: 938,044

[22] Filed: Dec. 4, 1986

[51] Int. Cl.[4] ..... B65B 9/08; B65B 9/12

[52] U.S. Cl. ..... 53/551; 53/554; 493/302

[58] Field of Search ..... 53/551, 552, 554, 575, 53/576, 451; 493/302, 196, 197

[56] References Cited

U.S. PATENT DOCUMENTS

| | | | |
|---|---|---|---|
| 3,122,072 | 2/1964 | Monsees et al. | 493/302 X |
| 4,043,098 | 8/1977 | Putnam, Jr. et al. | 493/302 X |
| 4,118,913 | 10/1978 | Putnam, Jr. et al. | 53/551 |
| 4,136,505 | 1/1979 | Putnam, Jr. et al. | 53/551 |
| 4,423,585 | 1/1984 | Monsees et al. | 53/551 X |
| 4,532,754 | 8/1985 | Hokanson | 493/302 X |

FOREIGN PATENT DOCUMENTS

| | | | |
|---|---|---|---|
| 156792 | 9/1982 | Fed. Rep. of Germany | 53/551 |

*Primary Examiner*—Horace M. Culver

*Attorney, Agent, or Firm*—Neal J. Mosely

[57] ABSTRACT

Wear strips removably installed on the tube forming apparatus of form-fill-seal packaging machines of the type having a tube former and depending tubular fill pipe through which quantities of product are passed and over which a strip of packaging material is pulled by transfer belts to progressively form the material into a depending and upwardly open tubular configuration and subsequently sealed to form product bearing packages. The wear strips comprise a pair of circumferentially spaced rectangular members removably attached to the fill pipe adjacent the transfer belts to receive substantially the full frictional wearing force caused by the transfer belts pressing and moving the packaging material against the fill pipe. The outer surface of the wear strips are configured to substantially reduce the contact surface area and the resulting wearing of the transfer belt and thus reduce the frequency of replacement and repair of the belts.

24 Claims, 6 Drawing Figures

PACKAGING MACHINES AND WEAR STRIPS THEREFOR

BACKGROUND OF THE INVENTION

1. Field of the Invention

This invention relates generally to packaging methods and apparatus, and more particularly to wear strips for installation on the fill pipe of form-fill-seal packaging apparatus to extend the life of the transfer belts.

2. Brief Description of the Prior Art

Packing machines of the so-called vertical form-fill-seal class are known in the art. Machines of this type guide a web of flexible packaging material from a supply roll of the material over a forming hood commonly known as a "former", where it is formed into an open ended tubing tubular configuration, intermittently fed downward, sealed to form a longitudinal tube seam, filled with a product, and ultimately sealed at package length intervals and cut into individual packages.

Many machines of the above described type incorporate transfer belts arranged on the sides of the fill tube. These belts are continious belts which are guided over rollers and press the tubular packaging material against the sides of the fill tube. During the movement of the belts, a part of the packaging material is pulled downwardly corresponding to the bag length. The belts must be replaced often due to friction and wear.

There are several patents which disclose packaging machines with formers which are designed to reduce the friction problem in the area of the forming hood.

Tanner, U.S. Pat. No. 3,486,424 discloses a winged former having a tubular removable wear insert within the former positioned to prevent contact and resulting wear by the web of critical guiding areas of the former and preformer portion so as to alleviate the problem of replacement and repair of the former.

Hobart, U.S. Pat. No. 3,962,958 discloses another tube former comprising a body and a detachable wear insert which jointly define a preformer surface over which the web of packaging material is pulled.

Putnam, Jr. et al, U.S. Pat. No. 4,043,098 discloses a packaging machine having vacuum belts. Vacuum belts are perforated and connected to vacuum means for suction gripping of the bag material as it is pulled down over the former. The generally hexagonal fill tube has two elongated narrow side spreaders in the region of the tube engagement with the belts to aid in proper engagement for the suction gripping of the vacuum belts.

Putnam, Jr. et al, U.S. Pat. No. 4,118,913 discloses a packaging machine having vacuum rollers which are perforated and connected to vacuum means for suction gripping of the bag material as it is pulled down over the former. The fill tube has two vertical back-up members in the region of the tube engagement with the rollers for firm engagement over a substantial portion of the roller peripheral surface.

James, U.S. Pat. No. 4,288,965 and British Pat. No. 2,056,940, and Cherney, U.S. Pat. No. 4,546,596, all assigned to Hayssen Manufacturing Co., Sheboygan, Wis., disclose form fill apparatus having vacuum belts arranged on the sides of the fill tube. The belts are guided over rollers and suction grip the bagging material and pull the packaging material downwardly corresponding to the bag length.

East German Pat. No. 156,792 discloses a form fill apparatus having continious belts arranged on the sides of the fill tube, and is directed toward a belt assembly which is easily removable for cleaning. A roller plate is installed between the driving pulley and the idler pulley and cooperates with another roller plate on the fill tube.

Russian Pat. No. 404,711 discloses another fill apparatus having continious belts arranged on the sides of the fill tube, and has a roller plate installed between the driving pulley and the idler pulley which cooperates with a roller plate on the fill tube.

The roller plate devices are undesirable because they are actually disposed on the inside surface of the bagging material as the bag is formed and filled. The rollers accumulate residue which is difficult to remove. Rollers and residue may also become dislodged and accidently packaged in the food product.

The present invention is distinguished over the prior art in general, and these patents in particular by the provision of replaceable wear strips installed on the tube forming apparatus of form, fill and seal packaging machines which have a depending tubular fill pipe through which quantities of product are passed and over which a strip of packaging material is pulled by transfer belts to progressively form the material into a depending and upwardly open tubular configuration and subsequently sealed to form product bearing packages. The wear strips comprise a pair of circumferentially spaced rectangular members removably attached to the fill pipe adjacent the transfer belts to receive substantially the full frictional wearing force caused by the transfer belts pressing and moving the packaging material against the fill pipe. The outer surface of the wear strips are configured to substantially reduce the contact surface area and the resulting wearing of the transfer belt so as to reduce the frequency of replacement and repair of the belts.

SUMMARY OF THE INVENTION

It is therefore an object of the present invention to provide wear strips for installation on the fill pipe of form-fill-seal packaging apparatus to extend the life of the transfer belts.

It is another object of this invention to provide wear strips for installation on the fill pipe of form-fill-seal packaging apparatus which will receive substantially the full frictional wearing force caused by the transfer belts pressing and moving the packaging material against the fill pipe.

Another object of this invention is to provide wear strips for installation on the fill pipe of form-fill-seal packaging apparatus which will substantially reduce the contact surface area and the resulting wearing of the transfer belt so as to reduce the frequency of replacement and repair.

Another object of this invention is to provide replaceable wear strips that are removably installated on the fill pipe of form-fill-seal packaging apparatus which will substantially reduce the cost of replacement and down time of the machinery.

A further object of this invention is to provide wear strips for installation on the fill pipe of form-fill-seal packaging apparatus which have replaceable wear inserts which will substantially reduce cost of replacement and down time of the machinery.

A still further object of this invention is to provide wear strips for installation on the fill pipe of form-fill-seal packaging apparatus which are simple in design, economical to manufacture, and rugged and durable in use.

Other objects of the invention will become apparent from time to time throughout the specification and claims as hereinafter related.

The above noted objects and other objects of the invention are accomplished by replaceable wear strips installed on the tube forming apparatus of form, fill and seal packaging machines which have a depending tubular fill pipe through which quantities of product are passed and over which a strip of packaging material is pulled by transfer belts to progressively form the material into a depending and upwardly open tubular configuration and subsequently sealed to form product bearing packages. The wear strips comprises a pair of circumferentially spaced rectangular members removably attached to the fill pipe adjacent the transfer belts to receive substantially the full frictional wearing force caused by the transfer belts pressing and moving the packaging material against the fill pipe. The outer surface of the wear strips are configured to substantially reduce the contact surface area and the resulting wearing of the transfer belt so as to reduce the frequency of replacement and repair of the belts.

DESCRIPTION OF THE PREFERRED EMBODIMENT

Figure 1:
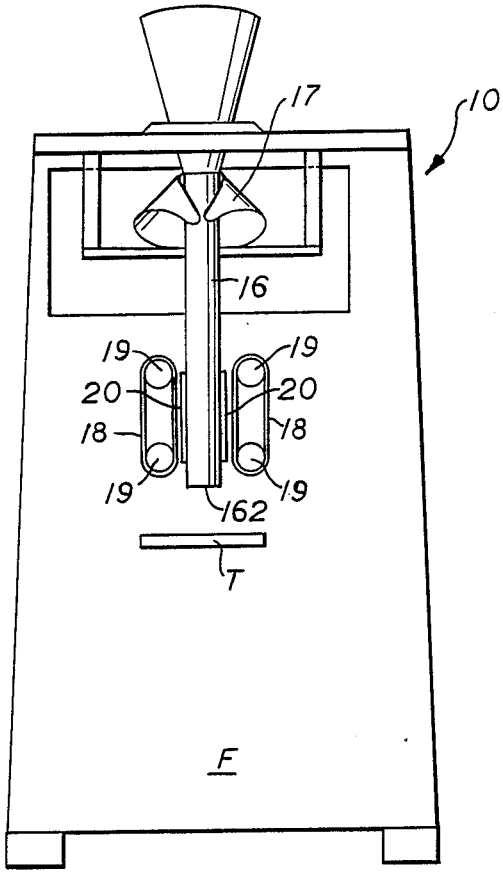
FIG. 1 is a front elevation view of a form-fill-seal packaging machine having wear strips installed on the forming apparatus.
Figure 2:
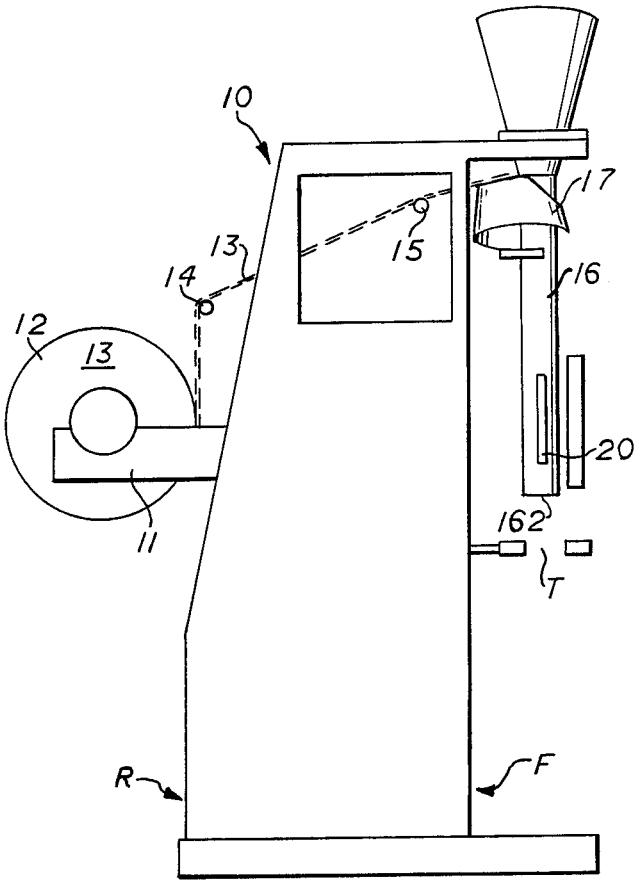
FIG. 2 is a side elevation view of the packaging machine of FIG. 2.

Referring to the drawings by numerals of reference, there is shown in FIGS. 1 and 2, a bagging or packaging machine 10 of the type used to form a sheet of plastic, foil, or other material into a bag, fill the bag with a food product, and seal the formed bag. The front side of the machine is identified generally with F and the backside of the machine identified generally with R.

A mounting bracket 11 for receiving a roll 12 is provided on the backside of the machine, which roll consists of a wound strip of packaging or bagging material 13. Common bag or packaging materials comprise weldable plastic foil, paper, or cellophane. The bagging material 13 is guided over rollers 14 and 15 from the backside R to the front side F.

Figure 3:
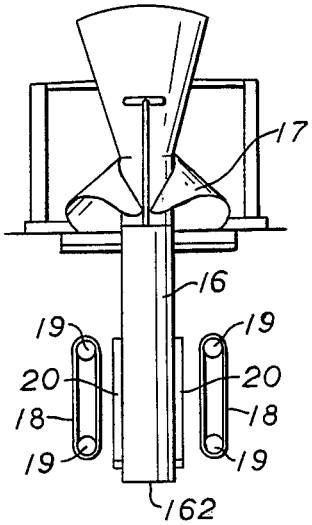
FIG. 3 is a front elevation view of a former having wear strips installed thereon.

Referring additionally to FIG. 3, a tubular fill pipe 16 which extends to the head of the machine and terminates at 16*a* is provided on the front side F of the machine. The upper portion of the fill pipe 16 is surrounded by a shaping member 17 which curves the sheet of packaging material into a tubular configuration as it moves from the rollers 14 and 15. Shaping member 17 is known in the art as a "former."

A dosing device (not shown) cooperates with the mouth of the fill pipe 16 for gravity feeding the material to be packaged into the fill pipe. A longitudinal sealing member L is provided adjacent the fill pipe 16 and a transverse sealing member T is provided beneath the bottom of the fill pipe.

A pair of horizontally spaced vertically extending transfer belts 18 respectively externally engage opposite sides of the tubular formed bagging material to draw the same downwardly through the former. The transfer belts 18 are arranged on the sides of the fill pipe 16. The transfer belts 18 are continious belts, which are driven by a motor over rollers 19 in opposite directions and at equal peripheral speeds to intermittently and sequentially draw the bagging material downwardly.

In most conventional bagging apparatus, these belts press the tubular bagging material 13 against the sides of the fill pipe 16. During the movement of the belts 18, a part of the bagging material 13 is pulled downwardly corresponding to the bag length. Due to friction and wear, the belts in conventional apparatus must be replaced fairly often.

Figure 4:
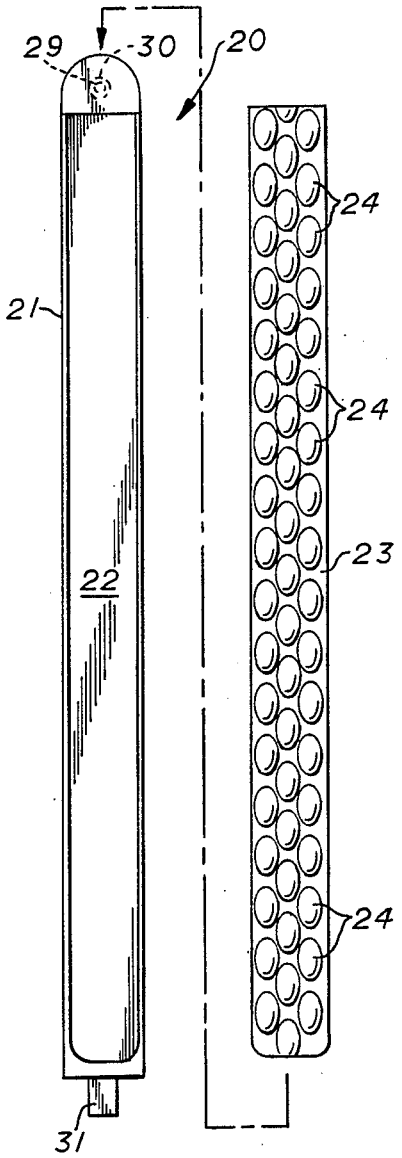
FIG. 4 is a front elevation view of a wear strip having a replaceable insert shown in the unassembled position.
Figure 5:
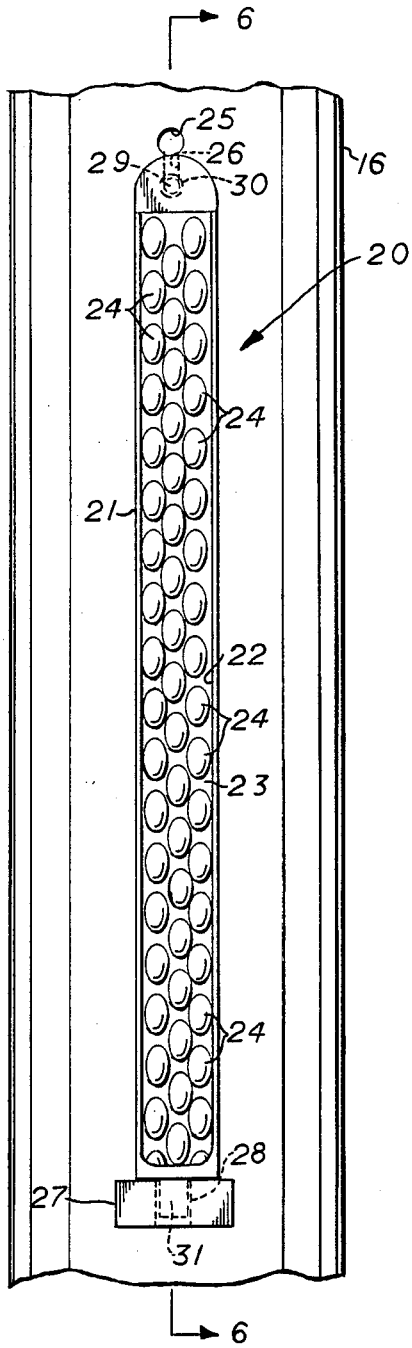
FIG. 5 is a front elevation view of the wear strip of FIG. 4 assembled and installed on a fill pipe.
Figure 6:
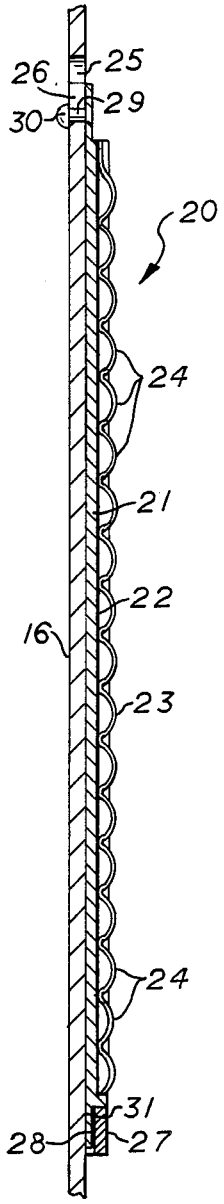
FIG. 6 is a longitudinal cross section of the wear strip assembly taken along lines 6—6 of FIG. 5.

In order to extend the life of the belts 18, elongated rectangular wear strips 20 are removably installed on the sides of the fill pipe 16. As best shown in FIGS. 4, 5 and 6, the preferred wear strip 20 comprises a two-piece assembly. A housing or holder 21 has a wide longitudinal groove 22 milled in the front or outer surface which slidably receives a thin stainless steel insert 23. The insert 23 is provided with a pattern or series of raised diamond bubble-shaped protuberences 24 which serve as a low friction contact surface against which the packaging material 13 is pressed by the belts 18 as the material is pulled downward.

Opposing sides of the fill pipe 16 are provided with an aperture having a circular top portion 25 and a vertical slot 26 depending therefrom. A short block 27 having a vertical slot 28 is secured on the fill pipe 16 a distance beneath the aperture. A small pin 29 having a headed top 30 extends outwardly a short distance from the backside of the wear strip holder 21 near the top end and the bottom end of the holder is provided with a depending flat tab 31. The holder 21 is installed by placing the pin 29 into the circular portion 25 and the tab 31 above the slot 28 and then lowering it to engage the headed pin 29 in the aperture slot 26 and the tab 31 in the slot 28. The inserts 23 may be easily installed by merely sliding them down into the milled groove 22 of the holder 21.

The wear strips 20 effectively extend the belt life due to the relatively small frictional contact area, and the cost of replacement is small because only the inserts 23 need to be replaced rather than the whole assembly. A preferred insert 23 is manufactured from stainless diamond patterned material which may also be custom treated with a special coating such as "Gullite®" to further reduce the friction. Gullite® is a registered trademark of Gull Industries, Inc., Houston, Tex. 77009. To replace the inserts 23, they are simply slid upwardly out of the milled groove 22.

It should be understood that various other materials, raised patterns, and coatings may used without departing from the scope of the invention.

OPERATION

The wear strips 20 are installed on the fill pipe and when the machine is activated, the bagging material 13 is pulled by means of the transfer belts 18 over the shaping member or former 17 and over the raised surfaces of the inserts. As the material passes over the former it is progressively formed into a depending and upwardly open tubular configuration, opposite longitudinal edge portions of the material being progressively juxtaposed by the former in parallel vertically extending relationship. During a forming of the bagging material 13 into a tube shape, the juxtaposed side edges of the material are positioned adjacent the longitudinal sealing member L. During a stand still time of the bagging material, the sealing member L is pressed onto the fill pipe 16 and the overlapping edges are welded together using heat or other conventional sealing methods to fixe the packaging material into a tubular configuration.

The transverse sealing member T simultaneously produces a head seam on a lower bag and a bottom seam on an upper bag. Simultaneously with the creation of these seams, or shortly thereafter, the lower finished bag is separated between the two transverse seams from the upper bag, which must still be produced. Fill material is dispensed, by gravity or otherwise, through the fill pipe via a dosing device located thereabove to fill the empty bag.

While this invention has been described fully and completely with special emphasis upon a preferred embodiment, it should be understood that within the scope of the appended claims the invention may be practiced otherwise than as specifically described herein.

I claim:

1. In a form, fill and seal packaging machine comprising;

a source of flexible packaging material in the form of a rolled elongated strip of packaging material, a tube former adapted to receive said strip material and progressively form the same to a depending and upwardly open tubular configuration, opposite longitudinal edge portions of the material being progressively juxtaposed by said former in parallel vertically extending relationship, a tubular fill pipe associated with said former and depending therefrom, the formed tubular configuration surrounding the exterior surface and through which measured quantities of product are passed, product dispensing means associated with said former and operable for the gravity discharge of measured quantities of product through said fill pipe to the formed tube interior through its upwardly open end, longitudinal seam sealing means disposed beneath said former adjacent said fill pipe and movable relative thereto into and out of sealing engagement with the juxtaposed edge portions of the tubular configuration, intermittently operable tube advancing means adjacent said wear means cooperative therewith to draw said tube downwardly therebetween whereby successively to present integral blanks in tubular form at said longitudinal seam sealing means, and end sealing means disposed beneath said fill pipe and operable intermittently to seal transversely end portions of said tubular blanks whereby to form product bearing packages, the combination with said fill pipe of wear means completely overlying and removably secured on the outer surface of said fill pipe across which the interior surface of the surrounding formed tubular configuration passes in frictional contact therewith and inclusing means to secure said wear means to said pipe.

2. A form, fill and seal packaging machine according to claim 1 wherein said tube advancing means comprises a pair of horizontally spaced vertically extending belts respectively externally engageable with opposite sides of the tubular configuration to draw the same downwardly through said former and across said wear means, and means for turning the belts in opposite directions and at equal peripheral speeds whereby to draw the tube downwardly.

3. A form, fill and seal packaging machine according to claim 1 wherein said wear means comprises low friction members removably attached to said fill pipe.

4. A form, fill and seal packaging machine according to claim 1 wherein said wear means comprises a pair of circumferentially spaced rectangular members removably attached to said fill pipe in a vertical position.

5. A form, fill and seal packaging machine according to claim 1 in which said wear means is formed of suitable material to substantially reduce friction and wear on the interior surface of the tubular configuration as it passes thereacross.

6. A form, fill and seal packaging machine according to claim 1 in which said wear means has a peripheral bearing surface configured to reduce the surface area of the interior surface of the tubular configuration in contact therewith as it passes thereacross.

7. A form, fill and seal packaging machine according to claim 1 in which;

said wear means comprises a holder member removably attached to said fill pipe, and an insert member removably carried thereby across which the interior surface of the surrounding formed tubular configuration passes.

8. A form, fill and seal packaging machine according to claim 7 in which said insert member is of suitable material to substantially reduce friction and wear on the interior surface of the tubular configuration as it passes thereacross.

9. A form, fill and seal packaging machine according to claim 7 in which said insert member has with a coating to substantially reduce friction and wear on the interior surface of the tubular configuration as it passes thereacross.

10. A form, fill and seal packaging machine according to claim 7 in which said insert member has a peripheral bearing surface configured to reduce the surface area of the interior surface of the tubular configuration in contact therewith as it passes thereacross.

11. A form, fill and seal packaging machine according to claim 10 in which said insert member peripheral bearing surface comprises a plurality of spaced raised surfaces which contact the interior surface of the tubular configuration as it passes thereacross.

12. A form, fill and seal packaging machine according to claim 10 in which said insert member peripheral bearing surface comprises a plurality of outwardly convex protuberences which contact the interior surface of the tubular configuration as it passes thereacross.

13. A form, fill and seal packaging machine according to claim 10 in which said insert member peripheral bearing surface comprises a plurality of outwardly convex protuberences which contact the interior surface of the tubular configuration as it passes thereacross, and said insert member has a coating to substantially reduce friction and wear on the interior surface of the tubular configuration as it passes thereacross.

14. A former for turning a thin strip of flexible packaging material into a tube comprising;

a shaping portion adapted to receive said strip material and progressively form the same to a depending and upwardly open tubular configuration, opposite longitudinal edge portions of the material being progressively juxtaposed by said former in parallel vertically extending relationship, a tubular fill pipe associated with said former and depending therefrom, the formed tubular configuration surrounding the exterior surface and through which measured quantities of product are passed, and wear means completely overlying and removably secured on the outer surface of said fill pipe across which the interior surface of the surrounding formed tubular configuration passes in frictional contact therewith and including means to secure said wear means to said pipe, said wear means cooperative with tube advancing means to be disposed adjacent thereto to draw said tube downwardly therebetween.

15. A tube former according to claim 14 wherein said wear means comprises a pair of circumferentially spaced rectangular members removably attached to said fill pipe in a vertical position.

16. A tube former according to claim 14 in which said wear means is formed of suitable material to substantially reduce friction and wear on the interior surface of the tubular configuration as it passes thereacross.

17. A tube former according to claim 14 in which said wear means has a peripheral bearing surface configured to reduce the surface area of the interior surface of the tubular configuration in contact therewith as it passes thereacross.

18. A tube former according to claim 14 in which;

said wear means comprises a holder member removably attached to said fill pipe, and an insert member removably carried thereby across which the interior surface of the surrounding formed tubular configuration passes.

19. A tube former according to claim 18 in which said insert member is formed of suitable material to substantially reduce friction and wear on the interior surface of the tubular configuration as it passes thereacross.

20. A tube former according to claim 18 in which said insert member has a coating to substantially reduce friction and wear on the interior surface of the tubular configuration as it passes thereacross.

21. A tube former according to claim 18 in which said insert member has a peripheral bearing surface configured to reduce the surface area of the interior surface of the tubular configuration in contact therewith as it passes thereacross.

22. A tube former according to claim 21 in which said insert member peripheral bearing surface comprises a plurality of spaced raised surfaces which contact the interior surface of the tubular configuration as it passes thereacross.

23. A tube former according to claim 21 in which said insert member peripheral bearing surface comprises a plurality of outwardly convex protuberences which contact the interior surface of the tubular configuration as it passes thereacross.

24. A tube former according to claim 21 in which said insert member peripheral bearing surface comprises a plurality of outwardly convex protuberences which contact the interior surface of the tubular configuration as it passes thereacross, and said insert member has a coating to substantially reduce friction and wear on the interior surface of the tubular configuration as it passes thereacross.

* * * * *